US006210501B1

(12) United States Patent
Okano et al.

(10) Patent No.: US 6,210,501 B1
(45) Date of Patent: Apr. 3, 2001

(54) HEAVY-DUTY COLD-ROLLING FOR MECHANICALLY DESCALING A HOT-ROLLED STEEL STRIP BEFORE PICKLING

(75) Inventors: Tetsuhiko Okano; Toshinori Miki; Masaki Otsuka; Junya Hayakawa, all of Osaka (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 08/849,215

(22) PCT Filed: Oct. 7, 1996

(86) PCT No.: PCT/JP96/02903

§ 371 Date: Aug. 21, 1997

§ 102(e) Date: Aug. 21, 1997

(87) PCT Pub. No.: WO97/13596

PCT Pub. Date: Apr. 17, 1997

(30) Foreign Application Priority Data

| | | |
|---|---|---|
| Oct. 11, 1995 | (JP) | 7-290314 |
| Oct. 11, 1995 | (JP) | 7-290315 |
| Oct. 11, 1995 | (JP) | 7-290316 |
| Oct. 11, 1995 | (JP) | 7-290317 |
| Oct. 12, 1995 | (JP) | 7-291715 |
| Sep. 19, 1996 | (JP) | 8-269226 |
| Sep. 19, 1996 | (JP) | 8-269228 |
| Oct. 11, 1996 | (JP) | 8-269229 |

(51) Int. Cl.[7] ..... C21D 6/00; B21B 45/06; B21B 45/08

(52) U.S. Cl. ..... 148/655; 148/602; 148/603; 266/112; 266/113; 266/136; 72/39; 72/40

(58) Field of Search ..... 148/579, 648, 148/602, 603, 653, 650, 655; 266/113, 112, 135, 136, 276; 29/81.01, 81.03, 81.08, 81.11, 81.12; 72/40, 38, 39

(56) References Cited

U.S. PATENT DOCUMENTS 3,841,126 * 10/1974 Minami et al. ..... 72/45
4,872,245 * 10/1989 Kawasaki et al. ..... 29/81.01

FOREIGN PATENT DOCUMENTS 55-134130 * 10/1980 (JP) .
357075216 * 5/1982 (JP) .

* cited by examiner

*Primary Examiner*—Sikyin Ip
(74) *Attorney, Agent, or Firm*—Armstrong, Westerman, Hattori, McLeland & Naughton

(57) ABSTRACT

When a hot-rolled steel strip 1 is rolled at a large rolling reduction by a cold-rolling mill 4, cracking and interlayer peeling occur in those mill-scales which can not keep up with the elongation of base steel so as to weaken the adhesiveness of the mill-scales to the base steel. When such a steel strip is then brushed, the threads of the brush penetrate into the cracks formed in the scale layer, whereby the mill-scales are removed from the steel strip. The rolling reduction R (%) is set to satisfy the formula of $t \times R \geqq 150$ in relation with the thickness t ($\mu$m) of the mill-scales. The mill-scales weakened in adhesiveness by the heavy-duty rolling are removed from the surface of the steep strip 1 by brush rolls 5 provided in the pass of the steel strip 1 between the cold-rolling mill 4 and the bridle rolls 5. Water or a water-soluble rolling oil having a large friction coefficient is preferably supplied to the roll bites between work rolls of the cold-rolling mill 4 and the steel strip 1 during the heavy-duty rolling. Since the steel strip 1 is given required properties by the heavy-duty rolling in advance of pickling 8, it is used as a cold-rolled steel strip having the required properties simply by heat treatment or slight cold-rolling after pickling.

12 Claims, 7 Drawing Sheets

HEAVY-DUTY COLD-ROLLING FOR MECHANICALLY DESCALING A HOT-ROLLED STEEL STRIP BEFORE PICKLING

This application is the National Stage of International Application No. PCT/JP96/02903, filed Oct. 7, 1996.

TECHNICAL FIELD OF THE INVENTION

The present invention relates to a method of mechanically descalilng a hot-rolled steel strip to largely reduce the load on the subsequent acid-pickling step, and also relates to an apparatus therefor.

BACKGROUND OF THE INVENTION

A hot-rolled steel strip is covered with mill-scales mainly composed of oxides. If the hot-rolled steel strip is subjected as it is to further processing steps such as cold-rolling, it leads to the occurrence of defects such as surface flaws and cracks caused by the mill-scales. In this consequence, the scales are generally removed from the surface of the hot-rolled steel strip by pickling, before the hot-rolled steel strip is subjected to further processing steps. In this process, there are problems on a pickling section, recycling process of waste acids, adjustment of descaling capability etc. There is also the fear that the properties of the steel material will deteriorate due to the penetration of hydrogen produced during pickling.

In order to solve these problems, there have been studied various methods of removing scales from the surface of a hot-rolled steel strip, before the hot-rolled steel strip is subjected to pickling. For instance, the step of cold-rolling a hot-rolled steel strip at a heavy rolling reduction (hereunder referred to as "mill-scale rolling") is disclosed in Japanese Patent Publication 54-133460, Japanese Patent Application Laid-Open 57-41821 and Japanese Patent Application Laid-Open 57-10917. Cracks are formed in the scales by the mill-scale rolling, and the adhesiveness of the scales to the steel strip is weakened, so as to facilitate the removal of the scales from the surface of the cold-rolled steel strip by shot blasting, high-pressure water spraying, brushing, grinding with abrasive grains, etc. As a result, the amount of scales adhering to the hot-rolled steel strip to be carried to the pickling tank is reduced, with a consequent reduction in the load on the pickling step.

Although the load on the pickling step is certainly reduced when the hot-rolled steel strip is subjected to the mill-scale rolling, there is the tendency for scale fragments which separated from the surface of the steel strip to become adhered to the surface of rolls, such as the bridle rolls, in latter steps, and subsequently become re-adhered onto the surface of the steel strip. The scales in this case are different from the scales present on the surface of the steel strip which is passed through a tension leveller, in that their adhesiveness to the surface of the steel strip is strong. Consequently, the amount of scales carried into the pickling tank is large, so as not to realize a reduction in the load on the pickling step as large as anticipated.

Furthermore, scale fragments which had once separated from the surface of the hot-rolled steel strip by the mill-scale rolling but then become firmly re-adhered or pressed back onto the surface of the steel strip, are difficult to remove in the pickling step and often tend to cause defects such as surface flaws in a subsequent cold-rolling step. Although grinding with abrasive grains has been used to try to remove the scale fragments, there are always some left remaining on the surface of the steel strip.

The inventors have carried out various studies into countermeasures to remove these residual scales which cause surface flaws in the product with the aim of exploiting the advantages of the mill-scale rolling which is effective in reducing the load on the pickling step. As a result thereof, the inventors found that when a hot-rolled steel strip is cold-rolled at a large rolling reduction under specified conditions, mill-scales can be efficiently eliminated from the surface of the steel strip with a resulting remarkable reduction in the load on the subsequent pickling step.

The present invention has been completed on the basis of the results of our investigation and research into the effects of heavy-duty cold-rolling on the peelability of mill-scales. The object of the present invention is to reduce the amount of mill-scales fed to a pickling tank, and to thereby deliver to subsequent steps a steel strip whose load on the pickling step has been reduced.

DISCLOSURE OF THE INVENTION

In order to attain said object, the present invention is characterized by maintaining the relationship between the thickness ($\mu$m) of mill-scales and a rolling reduction R (%) to $t \times R \geqq 150$, when a hot rolled steel strip having mill-scales adhered to the surface thereof is cold-rolled at a large rolling reduction of 30% or more and then brushed in advance of pickling to effect descaling.

At least a brush roll is provided at a predetermined point in the path of the steel strip between a cold-rolling mill and bridle rolls, and is used to remove from the surface of the steel strip those scale fragments which are peeled off or whose adhesiveness to the basic steel has been weakened. The scale fragments which have been transferred from the hot-rolled steel strip to a mill roll(s) are removed from the surface of the mill roll(s) by a polisher(s), a spray nozzle(s) or a scraper(s) and then discharged outside the processing line.

When the hot-rolled steel strip is cold-rolled at a large rolling reduction, water or a water-soluble rolling oil, which have a large friction coefficient, is preferably supplied to the roll bite of work rolls in the cold-rolling mill and the steel strip.

Those scales which can not keep up with the elongation of the base steel during the heavy-duty rolling facilitate cracking and interlayer peeling, and their adhesiveness to the base steel becomes weakened. When such a steel strip is then brushed, the threads of the brush penetrate into the cracks formed in the scale layer, so as to easily remove the scales from the surface of the steel strip. According to our studies and researches, it is noted that the peelability of mill-scales in this case largely varies depending on the rolling reduction. A large plastic deformation effective for scale peeling is realized by supplying water or a water-soluble rolling oil having a large friction coefficient to the roll bite of the work rolls and the steel strip.

The steel strip which has been cold-rolled at a large rolling reduction can be given the properties required for use in advance of a pickling step. Consequently, the steel strip can be used as a cold-rolled steel strip having the required properties just by simply heat-treating it or slightly cold-rolling it after pickling.

PREFERRED EMBODIMENT OF THE INVENTION

Figure 1:
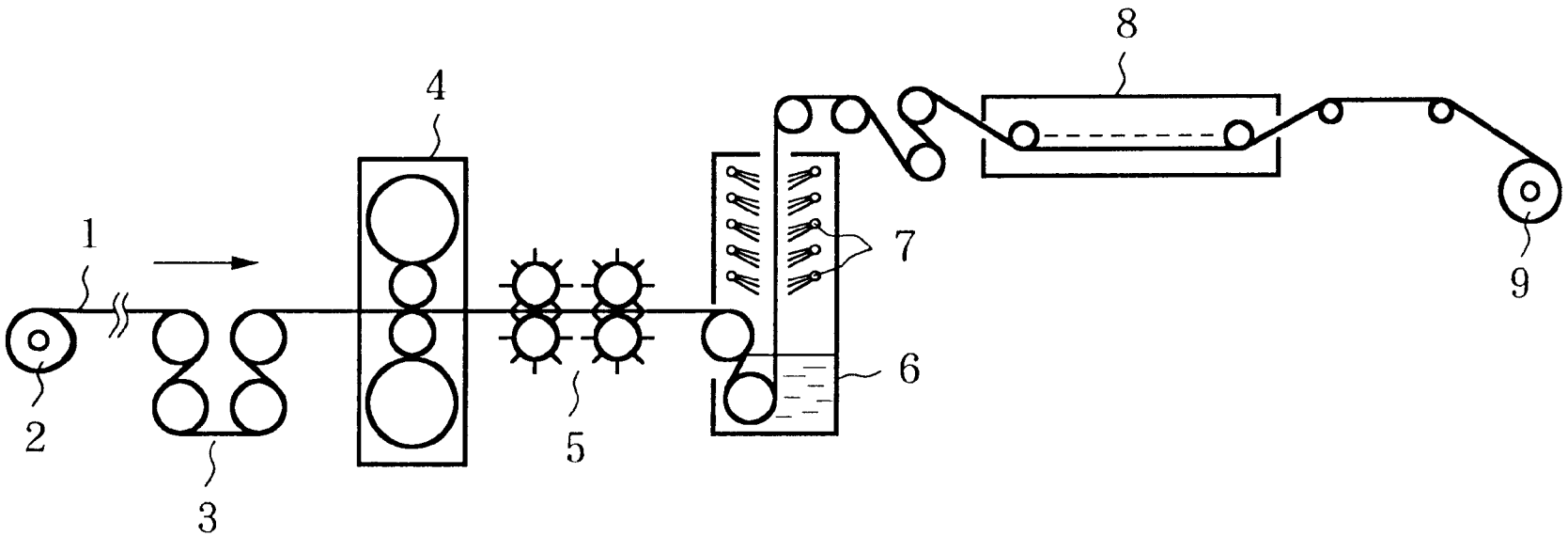
FIG. 1 is a schematic view illustrating a descaling line involving the step of heavy-duty cold-rolling according to the present invention.

The processing line according to the present invention has the lay-out as shown in FIG. 1. A hot-rolled steel strip 1 having mill-scales adhered to the surface thereof is paid off from an uncoiler reel 2, passed through bridle rolls 3 and then cold-rolled at a large rolling reduction in a cold-rolling mill 4. The mill-scales are cracked and crushed due to the heavy-duty rolling, and peeled off the steel strip 1. After the crushed pieces of scales left remaining on the surface of the steel strip 1 are removed with brush rolls 5, the steel strip 1 is carried to a spraying device 6, where the surface of the steel strip 1 is cleaned by high-pressure water sprayed from spray nozzles 7. The brushing may be divided into two steps, a first step for removing adhered scales by abrasive grains, and a second step for removing adhered scales by cleaning. A nylon brush containing abrasive silica or alumina grains etc. or notched-wire brush can be used. The steel strip 1 which has been treated in this way is then carried to a pickling tank 8, where a small amount of scales left remaining on the surface of the steel strip 1 are removed by pickling. The steel strip 1 is then coiled on a tension reel 9.

Figure 2:
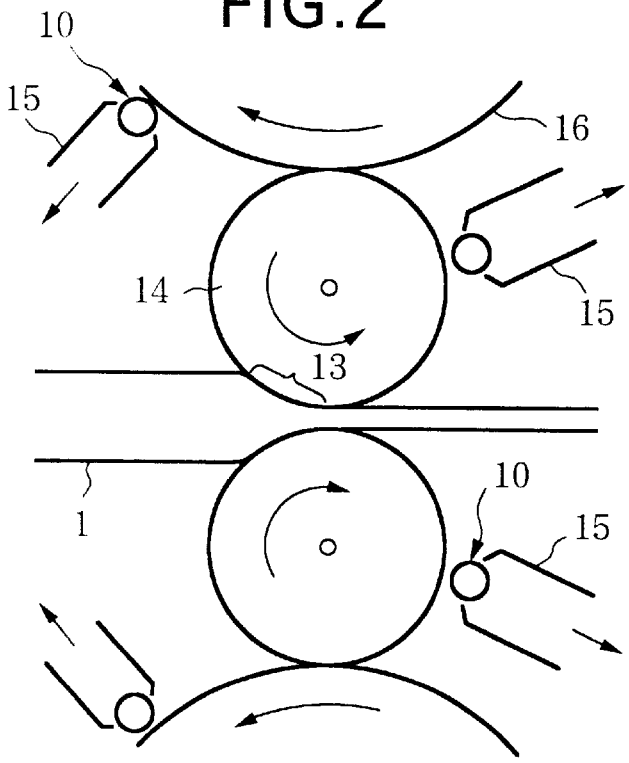
FIG. 2 is a sectional view illustrating polishers each directed to a work roll in a cold-rolling mill.
Figure 3:
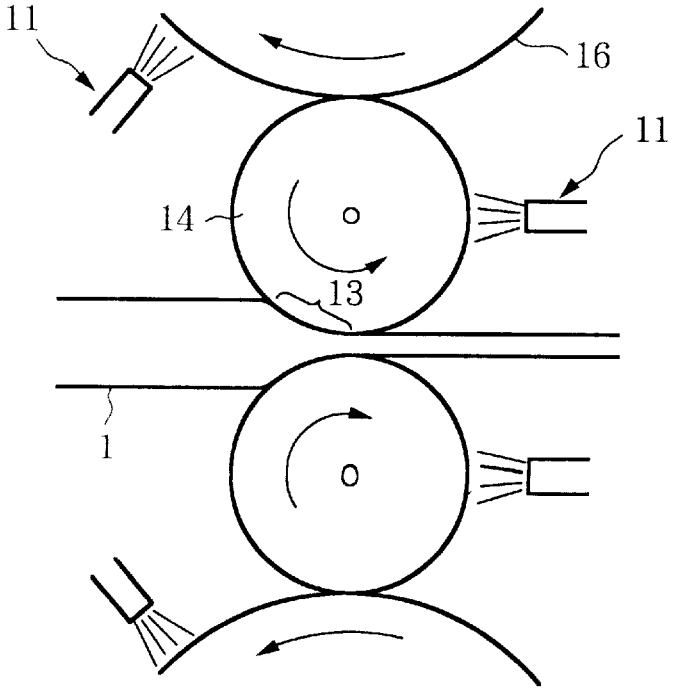
FIG. 3 is a sectional view illustrating spray nozzles each directed to a work roll in a cold-rolling mill.
Figure 4:
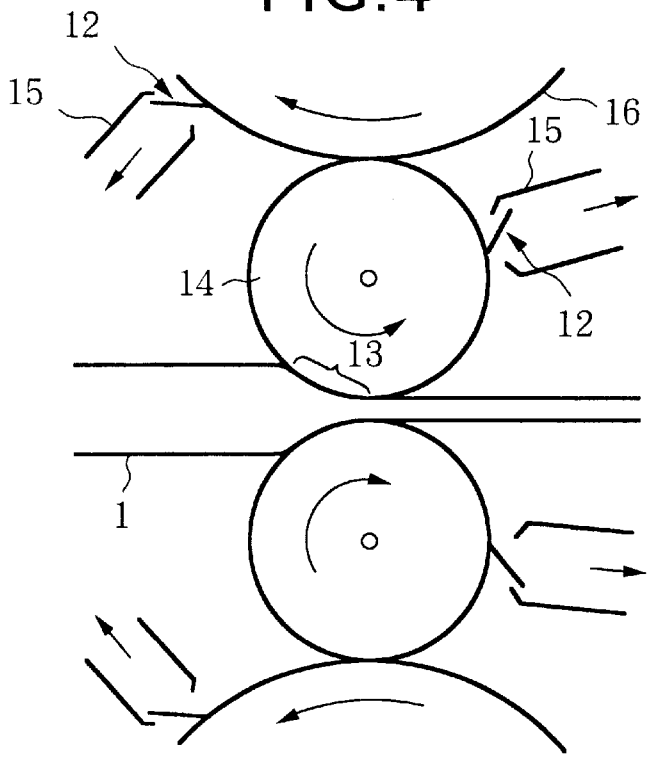
FIG. 4 is a sectional view illustrating scrapers each directed to a work roll in a cold-rolling mill.

The cold-rolling mill 4 preferably has rolls provided with polishers, spray nozzles or scrapers. For instance, polishers 10 (FIG. 2), spray nozzles 11 (FIG. 3) or scrapers (FIG. 4) are arranged against the surface of the work rolls 14 at a position just after a roll bite 13 along the direction of rotation. In the case where the adhered scales are removed from the surface of the work rolls 14 using the polishers 10 or the scrapers 12, a suction mechanism 15 is additionally provided which discharges the removed scale fragments out of the system in order to prevent the removed scales from becoming re-adhered to the surface of the rolls.

There is the fear that scale fragments which have been transferred to the surface of the work rolls 14 will be further transferred to back-up rolls 16 and then pressed back onto the steel strip 17 via the work rolls 14. Therefore, the same polishers 10, spray nozzles 11 or scrapers 12 may also be positioned against the back-up rolls 16.

The crushed pieces of scales transferred from the hot-rolled steel strip 1 to the surface of the work rolls 14 are removed from the surface of the work rolls 14 by the polishers 10, the spray nozzles 11 or the scrapers 12 each directed to the work roll 14, and then discharged outside the system. It is preferred that the polishers 10, the spray nozzles 11 or the scrapers 12 be arranged against the surface of the work rolls 14 at the position just after the roll bite 13 along the direction of rotation.

When the hot-rolled steel 1 is rolled with the work rolls 14 having no scales adhered thereto whilst the scale fragments transferred from the hot-rolled steel strip 1 to the work rolls 14 are removed in this way, the re-adhesion and pressing of scale fragments onto the steel strip 1 is inhibited, thereby obtaining a steel strip for which the amount of scales remaining thereon is largely reduced.

Figure 5:
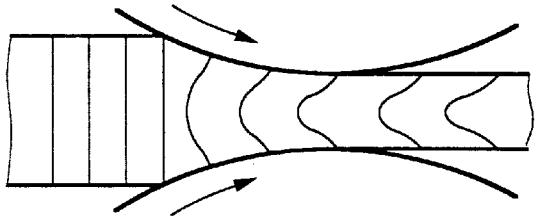
FIG. 5 is a schematic view for explaining a metal flow in a hot-rolled steel strip during heavy-duty cold-rolling.
Figure 6:
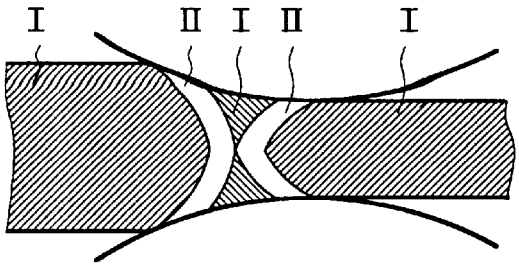
FIG. 6 is a schematic view for explaining deformation regions when a hot-rolled steel strip is cold-rolled at a large rolling reduction.

A mill-scale layer grows thicker as a steel strip is coiled at a higher coiling temperature when hot-rolled. When such a hot-rolled steel strip having scales adhered to the surface thereof is cold-rolled at a large rolling reduction, the metal flow during the cold-rolling can be divided into non-deformed parts I which are restrained by friction and main deformed parts II which undergo large reduction rollling, as shown in FIGS. 5 and 6. Internal stress is generated due to the uneven deformation, whereby cracking easily occurs in the scale layer. This is basically different from the metal flow generated when the steel strip is processed by a tension leveller which causes large deformations at the surface regions only.

The surface regions only are subjected to large deformations by tension leveling, whereas large deformations down into the internal region also occur during heavy-duty cold-rolling. Given the fact that the deformations near the boundary between the base steel and the scale layer is relatively large regardless of the thickness of the scale layer, this is thought to be the reason why scales easily become peeled off even in the case of thick scales. Furthermore, if the scales are thick, then the number of cracks produced also become large compared to the case when the scales are thin, which is also thought to promote the peeling of scales. Accordingly, with respect to thick scales, a sufficient scale peeling effect can be achieved without increasing a rolling reduction so much.

During our studies and researches into the effects of rolling reductions on scale layers, it is recognized from a lot of experimental results that scales in any thickness can be efficiently removed by controlling a rolling reduction according to the relationship defined by the formula of $t \times R \geqq 150$ between the thickness t ($\mu$m) of mill-scales and the rolling reduction R (%), when a hot-rolled steel strip is cold-rolled at a large rolling reduction. The formula of $t \times R \geqq 150$ was determined by various experimental data. If the equation is not satisfied, the effect of the heavy-duty rolling is reduced in that the descaling time in the subsequent pickling step becomes long.

In the cold-rolling mill 4, the hot-rolled steel strip 1 is cold-rolled at a large rolling reduction. It is therefore deemed necessary to provide some lubrication between the work rolls and the hot-rolled steel strip 1. However, if the normal oily lubricants are used, oil left on the surface of the steel strip 1 after the cold-rolling is fed to the pickling tank 8 and hinders recycling process of waste acid etc. In this sense, it is preferable to use water or a water-soluble rolling oil, which can be sufficiently washed away by high-pressure water sprayed through the spray nozzles 7 of the spraying device 6.

The water or a water-soluble rolling oil is also effective in promoting the peeling of the scales from the steel strip at the time of rolling. The metal flow during rolling is an uneven as shown in FIG. 5. Furthermore, there is a difference in the degree of deformation between the surface region and the core region of the steel strip along a direction vertical to the surface of the steel strip, as shown in FIG. 6. This rolled state and the difference in ductility between the scale layer and the base steel promote the peeling of the scale layers.

The degree of deformation is influenced by a friction coefficient $\mu$ acting at the roll bite 13. If the friction coefficient $\mu$ is large, a shear force $\tau$ ($=\mu P$) acting on the surface is also large. As a result, a restraining force acting on the surface of the steel strip is large, so that the uneven deformation becomes large along the direction vertical to the surface of the steel strip 1. Consequently, the scales is acceleratively peeled off.

Under normal cold-rolling conditions, a friction coefficient $\mu$ in the roll bite 13 is adjusted in the order of 0.03 or so by using a rolling oil fairly good of lubricity, so as to lower a rolling force and a mill motor power for achieving a large rolling reduction. A 1–5% water-soluble rolling oil is usually used as the rolling oil. The water-soluble rolling oil also effectively cools the work rolls and inhibits sticking at the roll bite.

According to the present invention on the contrary, it is important to cause large deformations in the internal region of the steel strip as shown in FIGS. 5 and 6 in order to mechanically descale the hot-rolled steel strip by heavy-duty cold-rolling. In this point of view, a rolling oil having a large friction coefficient is preferably used, and the hot-rolled steel strip 1 is cold-rolled under the condition that the lubricity of the rolling oil is somewhat reduced. In other words, the lubrication of the hot-rolled steel strip at the roll bit 13 is properly controlled by water or water-soluble rolling oil.

Especially when an water-soluble rolling oil having a friction coefficient $\mu$ in the range of 0.05 to $(0.15+\alpha\times D+\beta\times R)$(wherein $\alpha$: $1/7500$ (a constant), $\beta$: $-1/2500$ (a constant), R: a rolling reduction (%), D: a diameter (mm) of a work roll) is used, a large plastic deformation can be achieved which promotes the peeling of scales. The friction coefficient $\mu$ is preferably 0.05 or greater for effectively descaling a hot-rolled steel strip. However, if the friction coefficient $\mu$ is too great, the mill motor power and a rolling force necessary for rolling the hot-rolled steel strip unfavourably increase. The rolling costs which largely depend on the mill building costs taking power consumption, rolling force and torque into consideration decreases as the lubricity increases, but the pickling costs which largely depend on the amount of pickling liquid and pickling section building costs increase.

In the present invention, water or a water-soluble rolling oil is used for making a balance between rolling costs and pickling costs. If the friction coefficient $\mu$ is too great, a rolling force as well as a contact pressure at the roll bite increases. As a result, scales become pressed onto the base steel. This phenomenon is more striking the smaller the diameter of the work roll and the larger the rolling reduction. In this sense, it is necessary to fix an upper limit for the friction coefficient $\mu$ in relation to the work roll diameter D and the rolling reduction R, as defined in the above-recited formula.

When a hot-rolled steel strip is cold-rolled at a large rolling reduction, cracking and interlayer peeling occur in those scales which are unable to keep up with the elongation of the base steel, so as to reduce the adhesiveness of these scales to the base steel. The occurrence of cracking and interlayer peeling during the heavy-duty rolling would be caused by the under-mentioned phenomenon.

Figure 7:
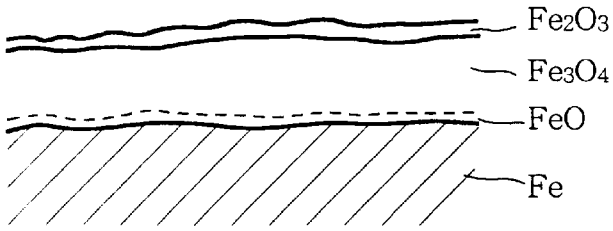
FIG. 7 is a schematic view illustrating the chemical structure of a scale layer formed on the surface of a hot-rolled steel strip.

The scales formed on the surface of the hot-rolled steel strip are mainly composed of $Fe_3O_4$. Conceptionally, it is thought that the scale layer has the piled-up structure of FeO, $Fe_3O_4$ and $Fe_2O_3$, as shown in FIG. 7, with oxygen concentration gradually increasing from the inner region toward the surface. In fact, there is the tendency that the FeO layer becomes thicker as the steel strip is cooled at a higher speed. A pseudo-rimmed steel has a relatively thin scale layer in the order of 6–7 $\mu$m, while a Ti-killed steel, which has a high coiling temperature when hot-rolled, has a relatively thick scale layer in the order of 9–10 $\mu$m.

The $Fe_3O_4$ and $Fe_2O_3$ layers which make up the majority of the scale layer are hard and brittle, and are easily prone to crack even at relatively small rolling reductions. For example, crackings occur and the layers peel off, even by the repetition of mechanical bending at about 2% elongation in a conventional tension leveling step which is carried out in advance of a picking step. Cracking also occur in the $Fe_3O_4$ and $Fe_2O_3$ layers with a device which repeatedly applies mechanical bending to a steel strip, as noted in a conventional pickling tank using sulfuric acid. On the contrary, the FeO layer which exists at the boundary between the scale layer and the base steel is so ductile to be deformed in step with the elongation of the base steel at a small rolling reduction. As a result, the FeO layer is not peeled off the base steel at elongation ratios of the order used in a tension leveller, and fed into a pickling tank. However, when the rolling reduction is set to a large value, the difference in the degree of deformation between the base steel and the FeO layer becomes large, and cracking occurs in the FeO layer which can no longer keep up with the elongation of the base steel.

In fact, when the crushed pieces of scales which had been peeled off the surface of a hot-rolled steel strip during cold-rolling were examined, it was observed that whereas the peeled scales formed at a low rolling reduction were large in size and flake-shaped, the peeled scales became powdery with an increase in the rolling reduction. The change in form of the peeled scales with a variation in the rolling reduction suggests the occurrence of cracking in the scale layer at the deeper region, in other words, into the FeO layer with the larger rolling reduction, resulting in the promotion of scale peeling. Consequently, the amount of scales left remaining on the surface of the steel strip after the heavy-duty cold-rolling is remarkably reduced.

However, the fragments of peeled scales are re-adhesive to the surface of the steel strip. Even after the scales are peeled away from the steel strip, there are the cases that the fragments of peeled scales are transferred to the surface of work rolls and then become re-adhered to or pressed back onto the steel strip. In this sense, the residual scales shall be removed from the surface of the steel strip by brushing the surface of the steel strip after the cold-rolling. The removal of the peeled scales unexpectedly improves the descaling effect of the heavy-duty cold-rolling, so that pickling conditions in a pickling tank can be remarkably eased.

Cracking and interlayer peeling occur in those scales which cannot keep up with the elongation of the base steel, when the hot-rolled steel strip is cold-rolled at a large rolling reduction. The adhesiveness of scales to the base steel is weakened due to the cracking and interlayer peeling. When such a steel strip is then brushed, the threads of brushes penetrate into the cracks in the scale layer so as to accelerate separation of scales from the surface of the steel strip.

A nylon brush containing abrasive grains of silica, alumina or the like may be used as a brush roll 5. The use of the brush roll containing abrasive grains further facilitates the removal of scales. Brushing applies a large descaling effect over the whole surface of the steel strip. The brushing may be divided into two steps, wherein the scales are ground away from the surface of the steel strip in the first step, and the scales are cleaned away in the second step.

Scales which still remain even after brushing are carried into a spraying device 6, wherein the residual scales are subjected to the shower of high-pressure water sprayed at a pressure of 1–5 MPa from spray nozzles 7. In this way, the remaining scales together with any water or an water-soluble rolling oil which was used for lubrication during rolling is washed away without causing any damage on the base steel. Even if there is any residual rolling oil, this oil is water-soluble and so does not put any harmful influences on an acid liquid in a pickling tank 8 and recycling process of waste acid.

Since most of scales are removed from the surface of the steel strip by brushing and spraying, the amount of scales which should be eliminated by pickling is slight. Consequently, the load on the pickling step is largely reduced. Furthermore, when hot water kept at a temperature of 80–90° C. is used as the high-pressure water for spraying after brushing, a steel strip can be carried into the pickling tank 8 without any falling in the temperature of the steel strip which was raised by a work heat during cold-rolling. The hot water also effectively removes the water or water-soluble rolling oil used for lubrication during cold-rolling. Thus, falling in the temperature of the pickling tank and infiltration of smuts can be avoided so as to pickle the steel strip under stable conditions and to save an energy necessary for keeping the temperature of the pickling acid.

In the descaling line, it is necessary to tension up the hot-rolled steel strip 1, since the hot-rolled steel strip 1 is cold-rolled at a predetermined rolling reduction. High tension is preferably applied from both the front and back in order to realize stability of the rolling mill 4, load reduction, shape stability, etc. Bridle rolls are normally used for application of such a tension. From upstream of the rolling mill 4, it is possible to apply the necessary tension to the hot-rolled steel strip 1 by bridle rolls 3 without causing any bad effects on descaling. On the other hand, if it were attempted to apply a tension using bridle rolls arranged downstream of the rolling mill 4, the steel strip 1 would pass through the bridle rolls under the condition that scales are partially peeled off and raised from the surface of the steel strip 1. As a result, scale fragments would become adhered to the bridle rolls and cause the contamination of the following steel strip or the formation of dents in the bridle rolls themselves.

Figure 8:
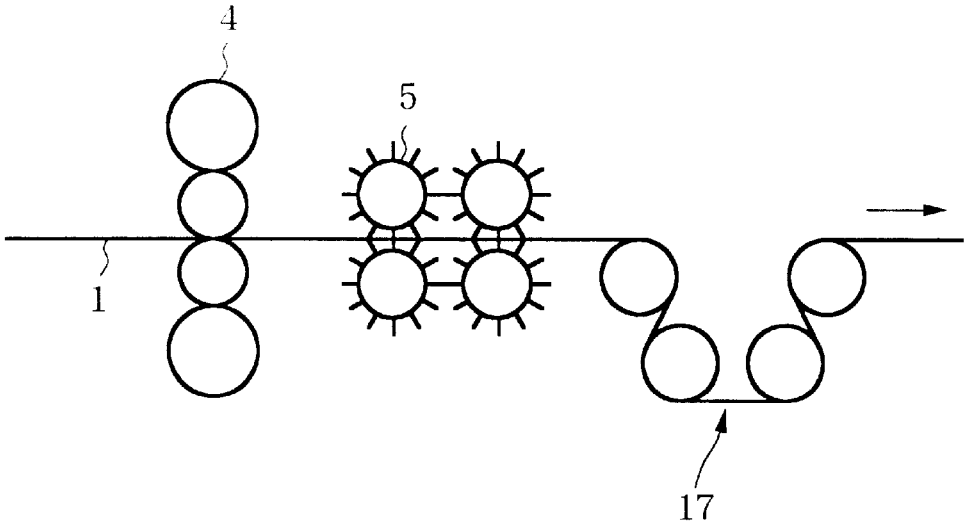
FIG. 8 is a schematic view illustrating bridle rolls provided on the downstream side of brush rolls.

In order to avoid such defects, brush rolls 5 are arranged before bridle rolls 17, as shown in FIG. 8. In the case where brushing and spraying are used in combination, bridle rolls 17 are arranged downstream of the spraying device 6, as shown in FIG. 19. In any case, the steel strip 1 whose scale layer has been cracked and peeled off by the heavy-duty cold-rolling is subjected to brushing and then optional spraying for removing those scales which can be readily peeled off, and then carried to the bridle rolls 17. In this way, no scale fragments are transferred to the bridle rolls 17, so as to inhibit the contamination of the following steel strip and the damage of the bridle rolls 17 due to the transferred scale fragments. Consequently, the steel strip 1 can be carried into the pickling tank 8 with its excellent surface property kept intact.

The steel strip is hardened by heavy-duty cold-rolling in the same way as ordinary cold-rolling process carried out after pickling, so that the required properties are given to the steel strip before pickling. In this sense, when the heavy-duty cold-rolling is substituted for conventional cold rolling after the pickling step, it is possible to simplify and shorten the process in total as well as to reduce the load on the pickling step. This kind of substitution is derived from the resolution of the problems on residual scales in the mechanical descaling prior to the pickling step.

The steel strip which has been cold-rolled at a rolling reduction of 10% or more in advane of pickling is work-hardened. Its hardness increases, but its ductility decreases. The larger the rolling reduction, the lower the re-crystallization starting temperature during annealing, and the more uniform crystal grains after annealing. If the crystal grains become coarse (the so-called grain growth), the surface of the steel strip becomes rugged so that excellent surface finish can not be obtained. In any case, a homogenous and stabilized metallurgical structure is formed in a steel strip after annealing, as far as the steel strip is cold-rolled at a rolling reduction of 40% or more.

Due to the rolling reduction to 40% or more during the heavy duty rolling in advance of pickling, a steel strip having an excellent metallurgical structure can be obtained by subsequent annealing. As a result, the pickled steel strip can be used as a material for coating, cold-rolled steel strip etc., simply by annealing the steel strip as it is or by cold-rolling at a small reduction and then annealing the steel strip. A large rolling reduction is preferable for improving the metallurgical structure of the steel strip. However, if the rolling reduction is too large, the contact pressure at the roll bite in addition to the rolling force becomes large, so that scale fragments are re-adhered and pressed back onto the base steel. Under these conditions, scales are not sufficiently removed from the surface of the steel strip, and the surface of the steel strip after pickling gets rough due to re-adhesion of scale fragments.

EXAMPLE

Example 1

Two kinds of hot-rolled steel strip of 2.5 mm in thickness were cold-rolled at a rolling reduction of 5–50% prior to pickling in the descaling line shown in FIG. 1. The hot-rolled steel strips used in this Example had the components and composition shown in Table 1, one of which a mill-scale layer of 15 $\mu$m in average thickness was formed thereon, and the other of which a mill-scale layer of 7 $\mu$m in average thickness was formed thereon.

TABLE 1

| CHEMICAL COMPOSITION OF HOT-ROLLED STEEL STRIPS (wt. %) | | | | | | |
|---|---|---|---|---|---|---|
| C | Si | Mn | P | S | Ti | Fe |
| 0.003 | 0.01 | 0.15 | 0.012 | 0.008 | 0.086 | bal. |

After the steel strip was cold-rolled, it was ground by rotating a nylon brush containing silica or alumina abrasive grains (360 mm in outer diameter prepared by twisting 3 threads of 1.6 mm in diameter together) at 1200 r.p.m. in contact with the surface of the steel strip.

Figure 10:
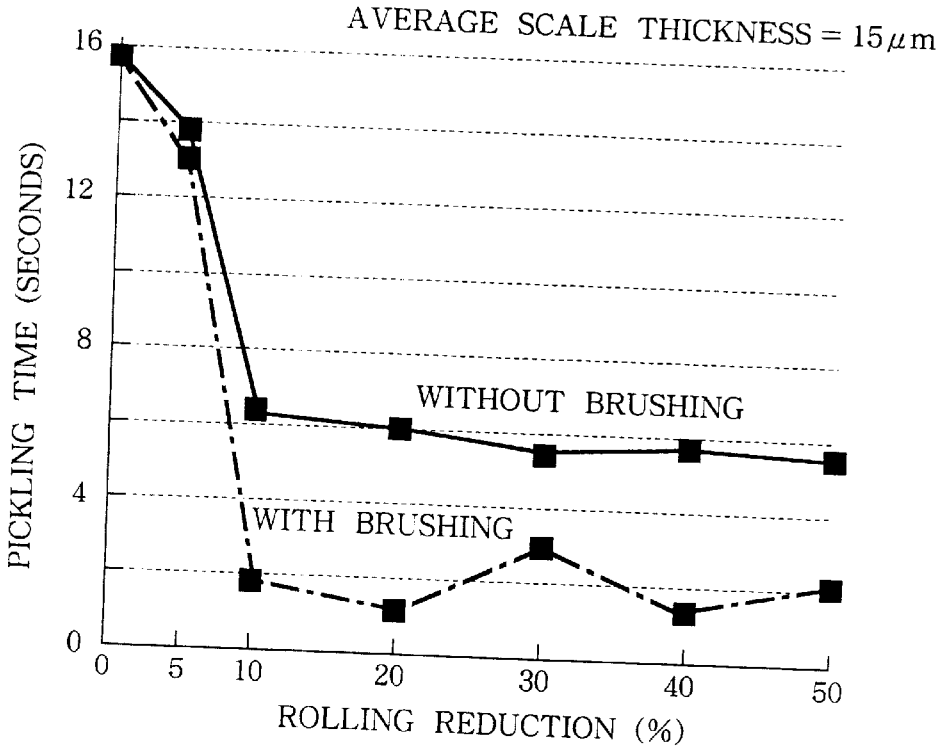
FIG. 10 is a graph showing the relationship between a rolling reduction and a pickling time in the case where a hot-rolled steel strip having a scale layer of 15 $\mu$m in thickness formed thereon is cold-rolled.
Figure 11:
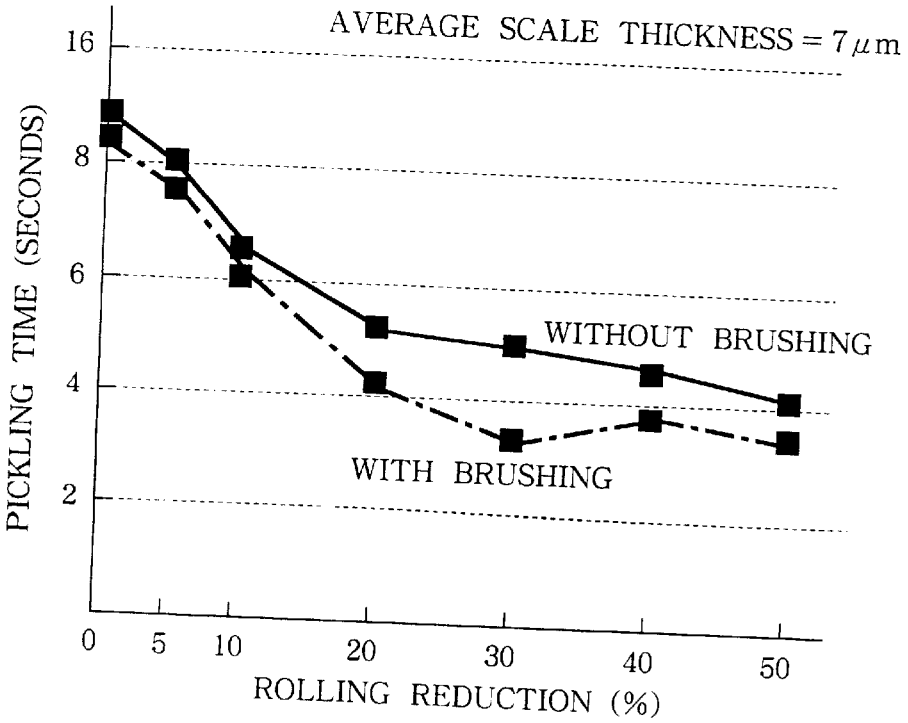
FIG. 11 is a graph showing the relationship between a rolling reduction and a pickling time in the case where a hot-rolled steel sheet having a scale layer of 7 $\mu$m in thickness formed thereon is cold-rolled.

Scale fragments remaining on the surface of the steel strip were washed away by spraying high-pressure hot water onto the surface of the steel strip, and then the steel strip was carried into a pickling tank filled with a hydrochloric acid solution of 10% concentration kept at 90° C. The pickling was continued until neither residual scales nor smuts derived from scales were observed on the surface of the steel strip. When the relationship between the pickling time and the rolling reduction under these conditions was researched, it was noted that the relationship varied in response to the thickness of the scale layer. In the case of the hot-rolled steel strip on which a relatively thick scale layer was formed in the order of 15 $\mu$m, the pickling time was remarkably shortened at a rolling reduction of 20% or more, as shown in FIG. 10. On the other hand, in the case of the steel strip on which a relatively thin scale layer was formed in the order of 7 $\mu$m, the pickling time was remarkably shortened at a rolling reduction of 30% or more, as shown in FIG. 11.

In a conventional pickling line, a pickling tank is designed to have a length of 80 to 90 m in order to ensure a sufficient pickling time of about 16 seconds. Since one of the objects of the heavy-duty rolling is to downsize the pickling tank, the relationship between rolling reductions and the thickness of scale layers was investigated under condition of a pickling time fixed at 5 seconds, so as to enable the adoption of a pickling time corresponding to half the length of the conventional pickling tank.

Figure 12:
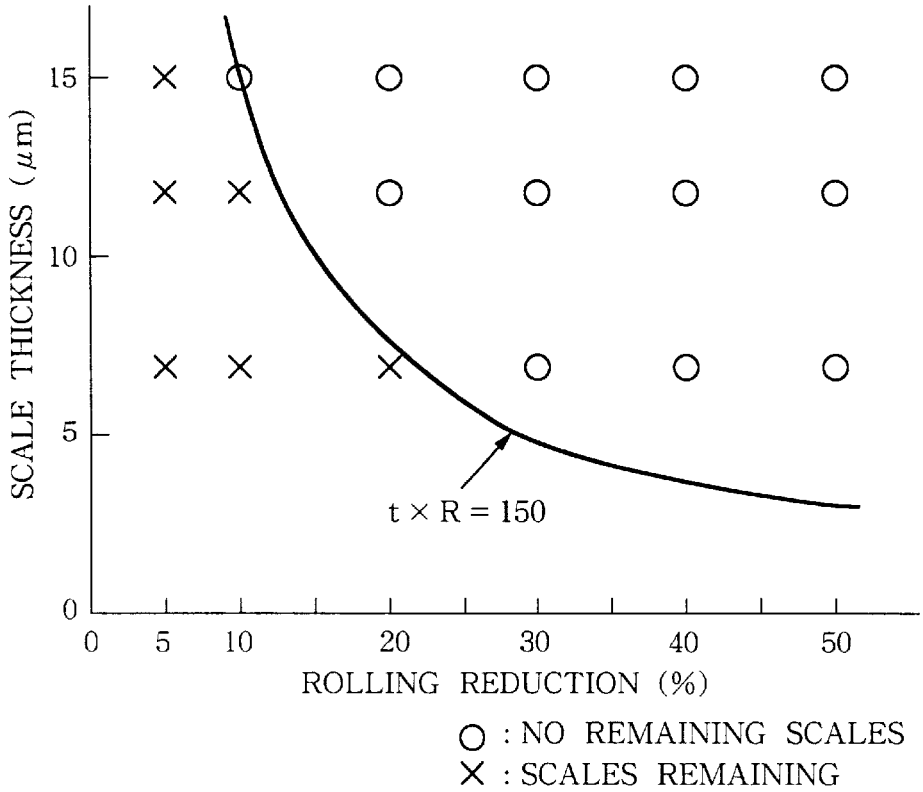
FIG. 12 is a graph showing the relationship between a rolling reduction and the thickness of scales in the case where a pickling time is kept to the fixed time of 5 seconds.

As can be noted from the results of the investigation shown in FIG. 12, the thicker the scale layers and the larger the rolling reduction, the smaller amount of residual scales under the above-mentioned conditions. The criticality which distinguishes the remaining or removal of scales is represented by the curved line corresponding to the production of the scale thickness t (mm) and the rolling reduction R (%). From our investigation, it was confirmed that scales were efficiently removed under the conditions which fulfill the formula of:

$$\text{scale thickness } t\ (\mu m) \times \text{rolling reduction } R\ (\%) \geqq 150.$$

When a hot-rolled steel strip was cold-rolled at a rolling reduction properly adjusted on the basis of thus-obtained relationship between the scale thickness and the rolling reduction, the scales were efficiently removed from the surface of the steel strip. The descaled steel strip, even after treated under substantially eased pickling conditions, was useful as a material for cold-rolling having excellent external appearance.

Example 2

Hot-rolled steel strips of 2.7 mm in thickness were cold-rolled at a rolling reduction of 50% in advance of pickling, using the same descaling line as that in Example 1. The hot-rolled steel strips used in Example 2 had the components and composition shown in Table 2, and mill-scales of 7–15 $\mu$m in average thickness were adhered onto the surface of the steel strips. During the heavy-duty rolling, water or a water-soluble rolling oil was supplied at a flow rate of 4.5 $m^3$/min to roll bites between the hot-rolled steel strip 1 and work rolls of 450 mm in diameter. The friction coefficient of the water-soluble rolling oil was adjusted to be in the range of 0.05 to 0.19 (=0.15+450/7500−50/2500).

TABLE 2

| HOT-ROLLED STEEL STRIPS USED IN EXAMPLE 2 | | | | | | |
|---|---|---|---|---|---|---|
| steel | Chemical Composition (bal.: Fe, wt. %) | | | | | |
| type | C | Si | Mn | P | S | Ti |
| A | 0.040 | 0.01 | 0.20 | 0.013 | 0.010 | — |
| B | 0.003 | 0.01 | 0.15 | 0.012 | 0.008 | 0.086 |

In the case of the so-called "dry rolling" without using any lubricant or water, lack of a cooling capacity makes temperature rise at the roll bite and causes sticking. When an oily lubricant was used without sufficiently washing away the lubricant before the pickling tank, the oil component infiltrated into the pickling tank. The infiltration of oil component caused the contamination of a waste acid processing section, resulting in a poor maintainability on a nozzle filter of an atomizing roaster used for recycling process of waste acids.

On the other hand, in the case using water or a water-soluble rolling oil which can be easily cleaned from the surface of the steel strip by brushing or spraying after the heavy-duty rolling, lack of cooling does not occur, and oily component is easily separated from the steep strip by the brushing or spraying without infiltration into the pickling tank. Consequently, a friction coefficient between work rolls and the steel strip is ensured at a value suitable for effective descaling during the heavy-duty rolling, and well balanced with a reduction in the mill motor power, rolling force, etc. by, for example, controlling the concentration of rolling oil.

By performing the heavy-duty rolling using water or a water-soluble rolling oil in this way, it was possible to avoid lack of cooling and contamination of the pickling tank with an oil component, whilst the steel strip was effectively descaled under conditions well balanced with a reduction in the mill motor power, rolling force, etc. When a friction coefficient was calculated back from an approximation of the Hill equation commonly used for calculation of a rolling force during cold-rolling, the values of the friction coefficient in this Example were about 0.05–0.2 as shown in Table 3. These values were considerably greater compared with the value of about 0.03 in conventional cold-rolling. However, the values of the friction coefficient in said range were suited to effectively descaling the steel strip. Upon observation of the surface of the steel strip after passing through the spraying device 6, no smuts left remaining on the surface of the steel strip were detected.

The steel strips which had been treated by water spray were carried into the pickling tank 8 receiving therein a hydrosulfuric acid kept at 90° C. and pickled by immersion for 6 seconds. The pickled steel strip showed excellent external appearance free from residual scales in any case.

The effect of the friction coefficient $\mu$ on the state of peeling of scales was then investigated. It is noted from the results shown in Table 3 that the shear force $\tau(=\mu P)$ was too small to promote peeling of scales in the range of small friction coefficients. However, in the range of too-large friction coefficients, the scale peelability rather became poorer. This is a result of scales becoming pressed back onto the base steel due to an increase in the rolling force in response to the friction coefficient $\mu$ and the consequent increase in a contact pressure at the roll bite.

TABLE 3

EFFECTS OF FRICTION CO-EFFICIENT ON PEELING STATE OF SCALES

| Friction Co-efficient $\mu$ | | 0.050 | 0.075 | 0.100 | 0.125 | 0.150 | 0.175 | 0.200 |
|---|---|---|---|---|---|---|---|---|
| Type-A Steel | Scale Peeling Rate | 70 | 85 | 90 | 90 | 85 | 75 | 60 |
| | Adherence of Residual Scale and Smuts | none | none | none | none | none | none | none |
| Type-B Steel | Scale Peeling Rate | 65 | 85 | 90 | 90 | 80 | 70 | 50 |
| | Adherence of Residual Scale and Smuts | none | none | none | none | none | none | none |

The scale peeling rate shows the percentage (%) of scales removed from the surface of a steel strip by brushing and spraying.
The adherence of residual scales and smuts was judged by observation of the surface of a pickled steel strip.

Example 3

Hot-rolled steel strips of 2.7 mm in thickness were cold-rolled at a rolling reduction of 50% in advance of pickling. The steel strips used in this Example were the same as those in Example 2.

In order to investigate the effects of scale fragments adhered to work rolls, the work rolls were treated in the following ways during cold-rolling.

Case 1:

A roll-shaped polisher made from a nylon brush containing silica or alumina abrasive grains and having a length equal to the barrel length of each work roll was pressed onto the surface of the work roll at a pressure of 1–4 MPa, and rotated by drive. Each polisher was received in the hood of a suction machine with the exception of the part thereof facing the work roll, and the air around the polisher was sucked up at a rate of 1–20 $Nm^3$/minute.

Case 2:

A nozzle having a slit length equal to the barrel length of each work roll was directed to the surface of the work roll, and high-pressure water was sprayed through the nozzle onto the surface of the work roll at a pressure of 1–50 MPa. The spray nozzle in this Case was provided diagonally at an angle of 45 degrees to the surface of the work roll, in order to prevent the sprayed water from bouncing off the surface of the work roll back into the nozzle.

Case 3:

A scraper made of hard felt and having a length equal to the barrel length of each work roll was arranged against the surface of the work roll. The work roll was rotated with the scraper pressed onto the surface of the work roll at a pressure of 1–4 MPa. Each scraper was received in the hood of a suction machine with the exception of the part thereof facing the work roll, and the air around the scraper was sucked up at a rate of 1–20 $Nm^3$/minute.

Case 4:

The work rolls were continuously used for heavy-duty rolling of a hot-rolled steel strip without subjecting the surface of the work rolls to any treatment.

A test piece was cut after cold rolled in each case, and then pickled to the degree usually demanded for materials to be cold-rolled. The pickling was performed as follows: An acid liquid substantially similar to an acid liquid used in an actual line was prepared to be 10% HCl+7% $Fe^{2+}$+1% $Fe^{3+}$, the acid liquid was kept at 90° C., and each test piece was immersed in the acid liquid. The pickling performance was judged from the immersion time necessary for achieving the above-mentioned finishing quality. As for the test pieces obtained in Cases 1 to 3, excellent external appearance necessary for materials to be cold-rolled was observed by pickling treatment in the very short period of 6 seconds. In contrast, slight amounts of residual scales were detected on the surface of the steel strip obtained in Case 4 even after continuation of pickling for 6 seconds or longer, and a large amount of scale-induced dents were observed on the surface of the steel strip.

The number and the size of residual scales and scale induced dents on the surface of each test piece after pickling were investigated. The number was counted by visual observation, and expressed as the number of scales per unit area (number/$m^2$). The size of the scale was measured using vernier calipers and an optical microscope.

It is noted from the results shown in Table 4 that steel strips excellent in external appearance with extremely few residual scales were obtained in the examples of the present invention where hot-rolled steel strips were cold-rolled at a large rolling reduction whilst removing scale fragments transferred to work rolls, and scale fragments becoming re-adhered to or pressed back onto the steel strip were not detected. In Case 4 wherein work rolls having scale fragments transferred thereon were used on the contrary, scale-induced dents and large numbers of scale fragments re-adhered to or pressed back onto the surface of the steel strip were detected on the surface of the obtained steel strip. In addition, the number of residual scales was relatively large.

It is recognized from this comparison that a steel strip excellent in external appearance can be obtained in a short pickling time in Cases 1 to 3 belonging to the present invention. The short pickling time enables construction of a small-sized pickling section and use of a low-concentration acid liquid, and also suppresses defects caused by absorption of hydrogen in the steel material.

TABLE 4

NUMBER AND SIZE OF SCALE-INDUCED DENTS AND RESIDUAL SCALES DETECTED ON THE SURFACE OF PICKLED STEEL STRIPS

| Case No. | 1 | | 2 | | 3 | | 4 | |
|---|---|---|---|---|---|---|---|---|
| Steel Type | A | B | A | B | A | B | A | B |
| Number (number/$m^2$) | 0 | 0 | 0 | 0 | 0 | 0 | 270 | 310 |
| Size (mm) | — | — | — | — | — | — | 10 × 30 | 15 × 30 |

Example 4

The same hot-rolled steel strips of 2.7 mm in thickness as those in Example 2 were cold-rolled at a rolling reduction of 50% in advance of pickling. Scale fragments transferred to the surface of work rolls were removed by polishers each directed to the surface of the work roll during the heavy-duty rolling.

In order to research the effects of processing conditions after the heavy-duty rolling, each steel strip proceeded to the pickling tank in the following tree ways.

Case 1 (shown in FIG. 8)

The steel strip was brushed by a nylon brush (360 mm in outer diameter prepared by twisting 3 threads of 1.6 mm in diameter together) rotated at 2000 r.p.m. in contact with the surface of the steel strip, and then proceeded to the pickling tank via bridle rolls.

Figure 9:
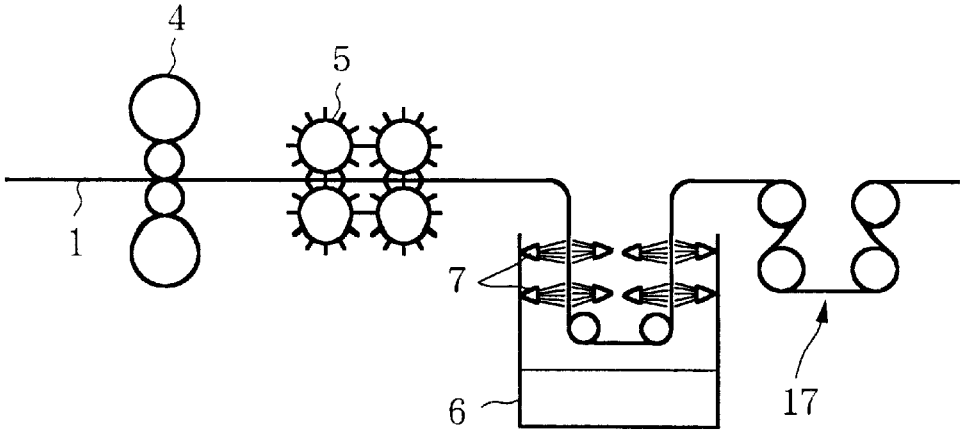
FIG. 9 is a schematic view illustrating bridle rolls provided on the downstream side of a spraying device.

Case 2 (shown in FIG. 9)

High-pressure water at 80° C. was sprayed onto the surface of the steel strip after brushing in the same way as Case 1, and then the steel strip proceeded to the pickling tank via bridle rolls.

Case 3 (Comparative Example)

Opposite to Case 1, the steel strip was brushed under the same conditions after it had left the bridle rolls, and then proceeded to the pickling tank.

In the pickling tank, each steel strip was pickled by immersing it for 2–20 seconds in a hydrochloric acid liquid kept at 90° C. the surface of each pickled steel strip was observed, and the results of Cases 1 to 3 were compared together. In Case 3, scales were partially separated from the steel strip, since the steel strip was bent along the bridle rolls. But, the separated scale fragments were pressed back onto the steel strip and the bridle rolls due to a pressure between the bridle rolls and the steel strip. The re-adhered scale fragments were repeatedly separated and re-adhered in response to rotation of the bridle rolls, and left scale-induced dents on the surface of the steel strip. The dents remained on the steel strip product as defects unacceptable from a quality point of view. In Cases 1 and 2 on the contrary, further peeling or re-adherence of scale fragments did not occur between the steel strip and the bridle rolls, since scale fragments were almost completely removed from the steel strip by brushing or spraying before the steel strip reached the bridle rolls.

It is clearly noted from the comparison that the steel strip 1 which proceeds to the pickling tank 8 is kept under conditions excellent in external appearance, and damage of the bridle rolls 17 by scale fragments is inhibited, by providing the bridle rolls 17 downstream of the brush rolls 5 and the spraying device 6. Consequently, the advantages of heavy-duty rolling can be exploited, and the load on the pickling step can be eased.

Example 5

A hot-rolled steel strip of 3.2 mm in thickness was used in this Example. The steel strip had the same composition as that in Example 2 and a scale layer of 10 $\mu$m in average thickness. The steel strip was cold-rolled at a rolling reduction of 5–50% in advance of pickling. Scale fragments transferred to the surface of work rolls were removed by polishers each directed to the surface of the work rolls during the heavy-duty rolling.

The steel strip descaled by the heavy-duty rolling proceeded into a pickling tank filled with a hydrochloric acid liquid kept at 90° C. and immersed in the acid liquid for 5 seconds. The pickling conditions were substantially the same as conventional conditions. Since the amount of scales fed into the pickling tank was extremely reduced, the pickled steel strip had surface properties superior to the results of conventional pickling.

After the steel strip was cold-rolled and then pickled, the steel strip was heat treated. The heat treatment was performed under the condition that the steel strip was heated up to 750° C. and then kept at the said temperature for 68 seconds. The metallurgical structure of the heat-treated steel strip did not become coarse but had a uniform and suitable grain size. The mechanical test results of the steel strip were also sufficient for a cold-rolled steel sheet.

Figure 13:
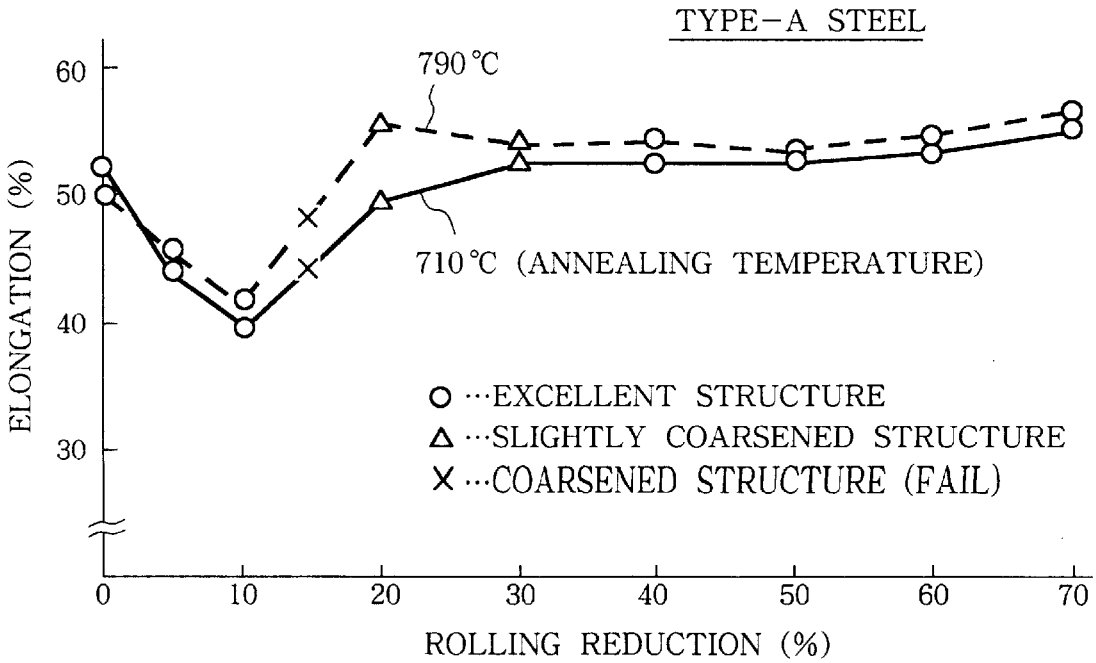
FIG. 13 is a graph showing the relationship between a rolling reduction and elongation when type-A steel in Example No. 5 was cold-rolled at a large rolling reduction.
Figure 14:
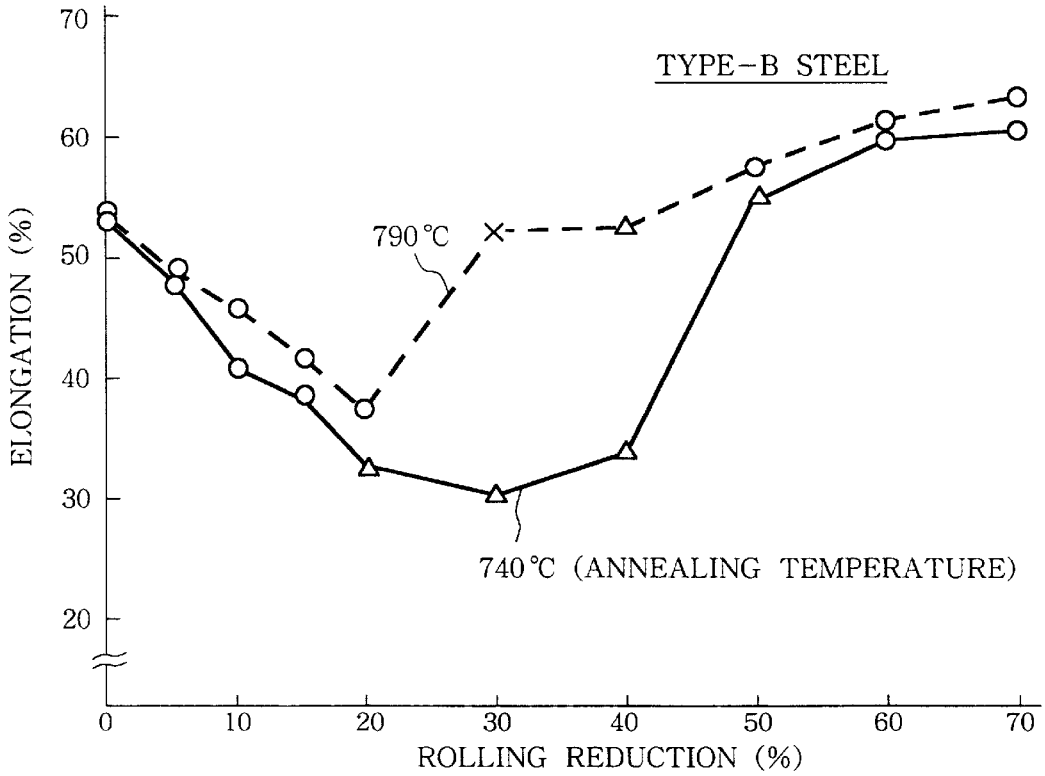
FIG. 14 is a graph showing the relationship between a rolling reduction and elongation when type-B steel in Example No. 5 was cold-rolled at a large rolling reduction.

For instance, the ductility of the steel strip was at the same level as that of a cold-rolled steel sheet produced by conventional methods. In actual, the ductility of type-A and B steels varied in response to rolling reductions, as shown in FIGS. 13 and 14, respectively. The effect of rolling reductions on ductility at a fixed annealing temperature was as follows: The ductility of the obtained steel strip decreased with an increase in the rolling reduction up to 10% in the case of type-A steel and up to 20% in the case of type-B steel. On the other hand, the ductility increased with an increase in the rolling reduction, in the range of rolling reductions over 10% in the case of type-A steel and over 20% in the case of type-B steel. However, the metallurgical structure of the steel strip cold rolled at rolling reductions smaller than 30% often caused grain growth. Accordingly, in order to produce a cold-rolled steel strip having required properties only by the heavy-duty cold-rolling, the steel strip was preferably cold-rolled at a rolling reduction of 40% or more in advance of pickling. In the range where the rolling reduction was 40% or more, the ductility increased with an increase in the rolling reduction, and the metallurgical structure was stabilized without grain growth.

INDUSTRIAL USE OF THE INVENTION

According to the present invention as above-mentioned, the majority of mill-scales layer formed on the surface of a hot-rolled steel strip were preparatively removed by heavy-duty cold-rolling in advance of pickling. The heavy-duty cold-rolling remarkably reduces the amount of mill-scales required to be removed by pickling, thereby pickling time can be shortened. Consequently, the load on the pickling step and recycling process of waste acids discharged from a pickling tank can be reduced.

The adhesiveness of mill-scales to the surface of the hot-rolled steel strip is weakened due to promotion of cracking and interlayer peeling by cold-rolling the steel strip at a rolling reduction defined in relation with the thickness of the mill-scales. When the steel strip in this state is then brushed, the scales are easily removed from the surface of the hot-rolled steel strip. When the heavy-duty cold-rolling is performed using water or a water-soluble rolling oil, the scale layer is effectively cracked and peeled off due to a rolling force during cold-rolling, whereby descaling is promoted.

The heavy-duty cold-rolling in advance of pickling is also effective for improving properties of the steel strip in addition to removal of mill-scales. Consequently, the steel strip cold-rolled at a large rolling reduction is useful as any kind of cold-rolled steel strip, by annealing the pickled steel strip or by slightly cold-rolling and then annealing the pickled steel strip.

What is claimed is:

1. A method of descaling a hot rolled steel strip comprising, in the following order, the steps of:

providing a hot-rolled steel strip having mill-scales adhered to a surface thereof;

cold-rolling the hot rolled steel strip at a rolling reduction of 30% or more;

brushing the cold-rolled steel strip;

spraying hot water on said brushed steel strip; and pickling the hot water sprayed steel strip;

wherein said cold-rolling steel is conducted so that said rolling reduction is according to the relationship between a thickness t ($\mu$m) of said mill-scales and said rolling reduction R (%) to satisfy $t \times R \geqq 150$.

2. A method of mechanically descaling a hot rolled steel strip comprising, in the following order, the steps of:

providing a hot-rolled steel strip having mill-scales adhered to a surface thereof;

cold-rolling the hot rolled steel strip with work rolls at a rolling reduction of 30% or more, while supplying water or a water-soluble rolling oil to roll bites of the work rolls and said steel strip, said water or water-soluble rolling oil having a friction coefficient $\mu$ in the range of 0.05 to $(0.15+\alpha \times D+\beta \times R)$, wherein $\alpha$ is a constant (1/7500), $\beta$ is a constant (−1/2500), R is a rolling reduction (%) and D is a diameter of a work roll;

brushing the cold-rolled steel strip for removing said mill-scales from the surface of said steel strip;

spraying hot water on said brushed steel strip; and pickling the hot water sprayed steel strip.

3. The descaling method according to claim 2, wherein the water-soluble rolling oil contains as the main component thereof at least a rolling oil selected from oils, fats, synthetic esters and mineral oils.

4. A method of mechanically descaling a hot rolled steel strip comprising, the in the following order the steps of:

providing a hot-rolled steel strip having mill-scales adhered to a surface thereof;

cold-rolling the hot rolled steel strip at a rolling reduction of 30% or more, while removing, with at least one selected from the group consisting of a polisher, a spray nozzle, and a scraper, scale fragments transferred from said hot-rolled steel strip to work rolls;

spraying hot water on said cold-rolled steel strip; and pickling the hot water sprayed steel strip.

5. The descaling method according to claim 4, wherein the scale fragments are removed from the surface of the work rolls to the outside by polishers each provided with a suction machine and directed to the surface of the work roll.

6. The descaling method according to claim 4, wherein the scale fragments are removed from the surface of the work rolls to the outside by spraying high-pressure water to the surface of the work rolls through spray nozzles each directed to the surface of the work roll.

7. The descaling method according to claim 4, wherein the scale fragments are removed from the surface of the work rolls to the outside by scrapers each provided with a suction machine and directed to the surface of the work roll.

8. An apparatus for descaling a hot-rolled steel strip comprising:

a cold-rolling mill for cold-rolling a hot-rolled steel strip having mill-scales adhered to the surface thereof at a rolling reduction of 30% or more;

brush rolls provided downstream of said cold-rolling mill for removing scale fragments which are peeling off or adhesiveness of which has been weakened by the cold-rolling;

a hot water spray nozzles downstream of said brush rolls;

a pickling tank provided downstream of said hot water spray nozzles; and bridle rolls provided downstream of said pickling tank for applying a tension to said steel strip.

9. The apparatus according to claim 8, wherein at least a spraying device for spraying high-pressure water onto the surface of the steel strip is provided between the brush rolls and the bridle rolls.

10. A method of descaling a hot rolled steel strip comprising, in the following order, the steps of:

providing a hot-rolled steel strip having mill-scales adhered to a surface thereof;

cold-rolling the hot rolled steel strip at a rolling reduction of 30% or more;

brushing the cold-rolled steel strip, for removing scale fragments peeled off the surface of said steel strip;

spraying hot water on said brushed steel strip;

removing residual scales from the surface of the hot water sprayed steel strip in a pickling tank; and then annealing the pickled steel strip.

11. The method of manufacturing a cold-rolled steel strip according to claim 10, wherein the hot-rolled steel strip is cold-rolled at a rolling reduction of 40% or more.

12. The method of manufacturing a cold-rolled steel strip according claim 10, wherein the steel strip is treated by water spray during brushing or between brushing and pickling.

* * * * *